United States Patent [19]

Sorenson

[11] Patent Number: 4,686,336

[45] Date of Patent: Aug. 11, 1987

[54] APPLIANCE SWITCH

[75] Inventor: Richard W. Sorenson, Avon, Conn.

[73] Assignee: Carlingswitch, Inc., West Hartford, Conn.

[21] Appl. No.: 926,912

[22] Filed: Nov. 3, 1986

[51] Int. Cl.[4] ..... H01H 3/16

[52] U.S. Cl. ..... 200/61.62; 200/61.76

[58] Field of Search ..... 200/61.62, 61.71, 61.83, 200/295, 303, 339

[56] References Cited

U.S. PATENT DOCUMENTS

| | | | |
|---|---|---|---|
| 3,691,325 | 9/1972 | Bognar | 200/295 X |
| 3,694,595 | 9/1972 | Horecky | 200/61.76 |
| 4,281,229 | 7/1981 | Poleschuk et al. | 200/61.76 X |
| 4,514,603 | 4/1985 | Staples | 200/61.62 |

*Primary Examiner*—J. R. Scott

*Attorney, Agent, or Firm*—McCormick, Paulding & Huber

[57] ABSTRACT

An appliance switch has a one-piece housing defining separate cavities for the rocker/actuator and for the switch contact elements. An inner wall of the housing is integrally formed for this purpose, and defines a boss for slidably receiving a plunger that engages the rocker/actuator. The contact elements are identically shaped, each having an L-shape configuration with a resilient leg engageable with the plunger, and with a plunger hole that receives the plunger in the fixed contact element. A cover closes the cavity for the fixed and movable contact elements and also serves to hold them in place.

9 Claims, 4 Drawing Figures

APPLIANCE SWITCH

This invention relates generally to door operated appliance switches and deals more particularly with a switch adapted to be held closed by the door of a refrigerator or freezer.

In the environment for appliance switches of the type used in refrigerators or freezers at least a portion of the switch is necessarily exposed to above average wear and tear in that cleaning solutions or the like are apt to be used to clean the refrigerator or freezer, and such solutions can effect the electrical conductors provided within the switch housing. The present invention seeks to provide a sealed environment for the switch contacts themselves, and to provide for draining off such solutions from that part of the switch into which such solutions are apt to enter.

PRIOR ART

In U.S. Pat. No. 4,514,603 there is described and claimed a switch in which two compartments are provided for, one being for the switch elememnts and one for the switch actuating elements. The switch housing in this prior art design entails use of a three part housing which must be assembled in order to provide a switch with two isolated compartments or cavities. More particularly, the divider wall between the two compartments is formed in a member which is inserted into the bottom of the housing itself, requiring a third part in the form of a base or cover to close the compartment for the switch elements.

The present invention seeks to obviate the need for such a three part housing, and to provide further advantages in the configuration for the fixed and movable contact elements.

SUMMARY OF THE INVENTION

In accordance with the present invention a generally rectangular one-piece switch housing is provided having an upwardly and a downwardly open cavity separated by and internal wall defined integrally with the housing itself. A plunger is slidably received in a boss provided in the internal wall of the housing, and the upper end of the plunger provided in the upwardly open cavity engages the underside of a pivotably mounted rocker in the upper cavity. Fixed and movable switch contact elements of identical configuration are provided in the downwardly open cavity and one of these contact elements is fixed in position by an abutment on the integral housing wall while the other contact element is movable, being engaged by the lower end of the plunger which extends through an opening in the fixed contact element.

Each of the two identical switch elements is of a generally L-shape having a cantilevered resilient portion and a terminal blade portion that projects outside of the switch housing. These fixed and movable contact elements are provided one above the other in the switch housing, and a lower cover is provided for closing the cavity in which these switch elements are housed.

The rocker is provided pivotably adjacent one end of the upper cavity in the housing so that the free end of rocker is adapted to move through a larger displacement than that of the plunger itself. Two slots are provided in the opposite end of the upper housing cavity. The lower ends of these slots are at the same height as the integral inner wall defined by the housing so as to drain off any excess liquid from the upper cavity. These slots serve to receive tabs provided for this purpose on the rocker itself and have upper ends that define the upper limit position for the rocker. These tabs may engage the inner wall to determine the lower limit position for the rocker.

DETAILED DESCRIPTION

Figure 1:
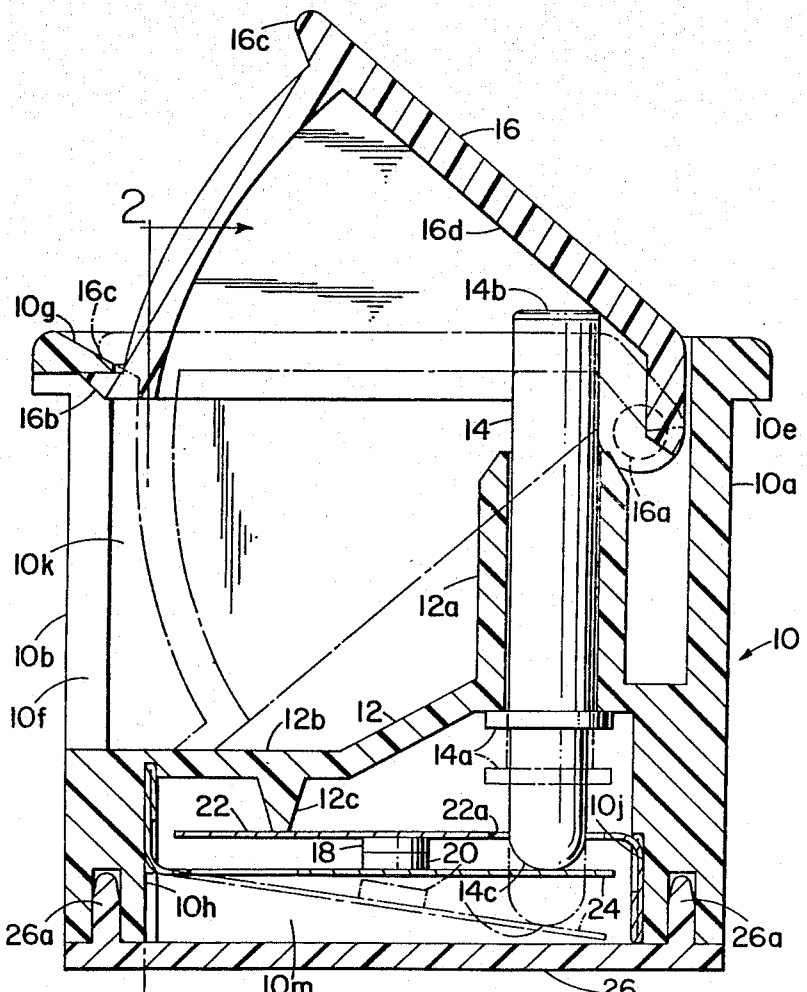
FIG. 1 is a vertical sectional view through an appliance switch constructed in accordance with the present invention.

Turning now to the drawings in greater detail, a switch embodying the present invention is illustrated in vertical section in FIG. 1 with the movable parts in alternative positions, the solid line position indicating the switch in its "on" condition and the phantom line position indicating the switch components in their "off" condition.

The switch comprises a generally rectangular housing 10 having upwardly and downwardly open cavities 10*k*, 10*m* separated by an internal wall 12 that is defined integrally with the housing 10.

Figure 2:
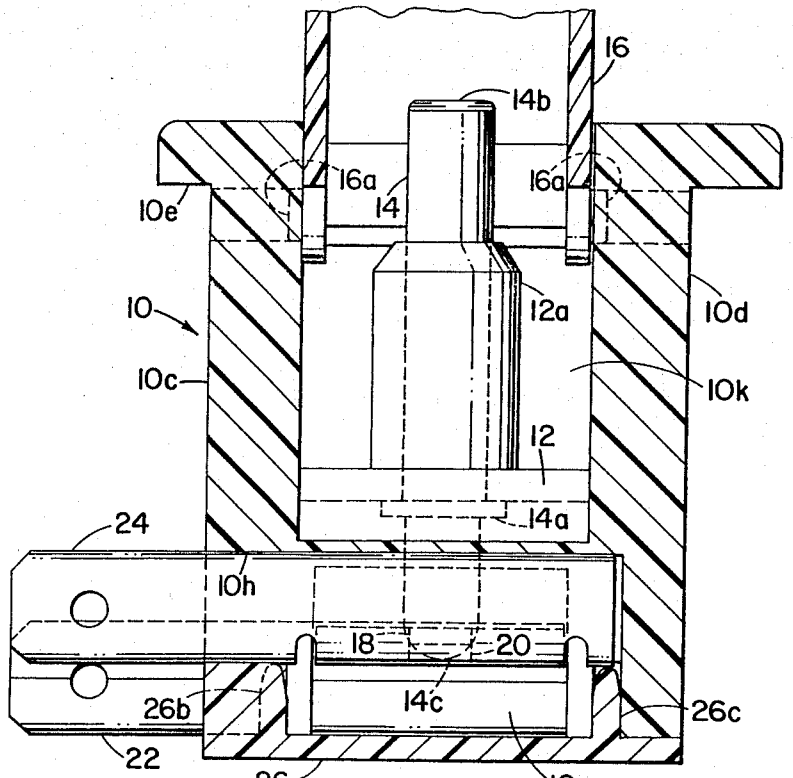
FIG. 2 is a sectional view taken generally on the line 2—2 of FIG. 1.

The housing 10 includes oppositely arranged end walls one of which is illustrated at 10*a* and the other being illustrated at 10*b* in FIG. 1. The side walls 10*c* and 10*d* are illustrated in FIG. 2, and these walls 10*a*, 10*b*, 10*c* and 10*d* cooperate with one another to define a generally rectangular external configurations for the housing. A flange or bezel portion 10*e* is provided at the upper end of the housing 10 so that the switch can be conveniently mounted in a rectangular opening provided for it in the path of movement of the door of the appliance to be equipped with a switch in accordance with the present invention. Although not shown in the drawings, panel mounting wings may be provided on at least one side or end of the switch housing to facilitate installation of the switch in an appliance door opening.

A vertically reciprocable plunger 14 is provided in a boss 12*a* and more particularly in an opening defined by the boss 12*a* provided for this purpose in the integrally formed wall 12 of the housing 10. As so arranged the plunger 14 can be moved between the positions shown in solid and phantom lines in FIG. 1. The plunger 14 is formed of an insulating plastic material similar to that used in the housing 10, and may include a flanged portion 14*a* adapted to engage the underside of the wall 12 of the housing 10 to define the upper limit position for the plunger.

A rocker 16 is pivotably provided in the upper cavity 10*k* defined by the housing 10 and this rocker 16 is movable from a solid line position as shown in FIG. 1 to the phantom line position of FIG. 1 either manually or by reason of shutting the door of an appliance equipped with the switch constructed in accordance with the present invention. The rocker 16 has axle defining portions 16*a* provided in aligned openings in the side walls 10*c*, 10*d* of the switch housing 10. Thus, means is provided for pivotably mounting the rocker 16 and said means is defined in part by the rocker itself and in part by the housing 10 so as to define a pivot axis for the rocker located adjacent the one wall 10*a* of the housing 10 and more particularly between this wall and the boss 12*a* which slidably supports the plunger 14.

Still with reference to the rocker 16 this component is also fabricated from an insulating plastic material and is substantially hollow defining a downwardly facing surface 16*d* that abuts the upper end 14*b* of the plunger 14, and the rocker 16 further defines at least one and preferably two projecting tabs 16*b* that move in slots 10*f* defined for them in the housing end wall 10*b* opposite the one wall 10*a* referred to previously with reference to the pivot axis of the rocker 16. These tabs 16*b* are adapted to engage the uppermost end of the slots 10*f* in order to define an upper limit position for the rocker 16 as best shown in FIG. 1. The down or lower limit position for the rocker 16 illustrated in phantom lines in FIG. 1 is determined by engagement between these same tabs 16*b* and the top of the integral inner wall 12 of the housing 10 as illustrated generally at 12*b* in FIG. 1. Alternatively, or to provide a supplementary limit stop for the down position of the rocker 16 a second projecting tab 16*c* may be provided on the rocker for engaging a detent provided for this purpose in the housing bezel 10*e* as indicated generally at 10*g* in FIG. 1.

Figure 4:
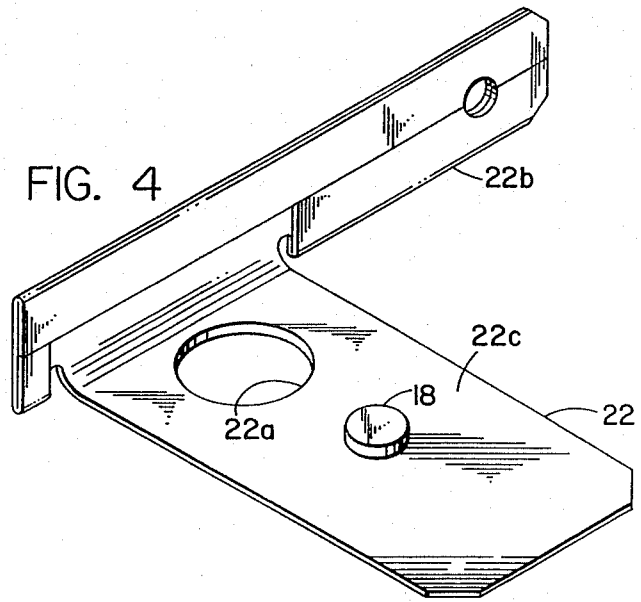
FIG. 4 is a perspective view from above and to the right illustrating the movable contact of FIG. 1 (both the fixed and movable contact elments of FIGS. 3 and 4 being identical).

Turning next to the downwardly open cavity 10*m* which houses the fixed and movable switch contact elements, the contact elements are prefrably fabricated from conductive material such as sheet metal and each contact element may include a precious metal contact abutment surface 18 or 20. The contact abutment surface 18 is best shown in FIG. 4.

Figure 3:
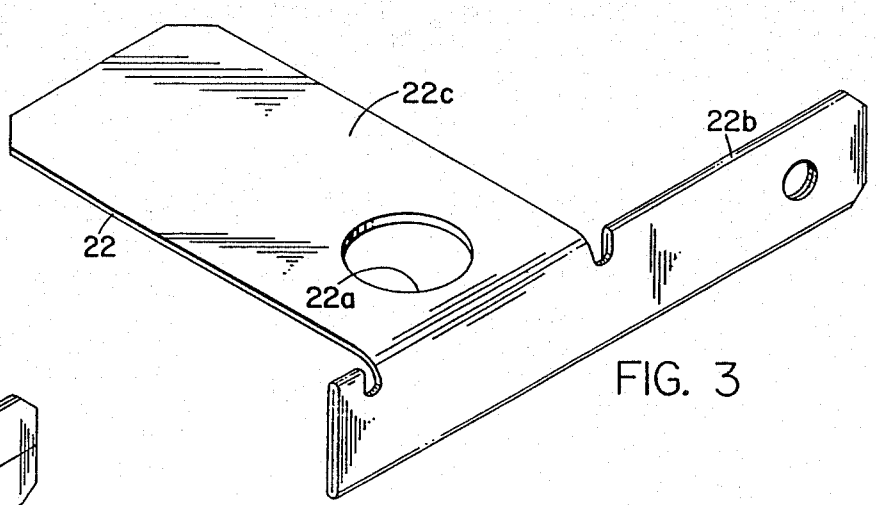
FIG. 3 is a perspective view taken from above and to the right illustrating the fixed contact to FIG. 1.

The fixed contact element 22, that is the upper contact element associated with abutment surface 18, has an opening 22*a* for loosely receiving the lower end 14*c* of the plunger 14 and to provide clearance for the plunger so that the tip of the plunger can engage the movable contact 24. Actually, the contact elements 22, 24 are identical to one another and the fixed contact element 22 is held from movement by a depending web or flange 12*c* provided for this purpose on the integral inner wall 12 of the housing 10. The movable or lower contact element 24 is not so supported and is therefore movable by the plunger from the solid line position shown for it in FIG. 1 to the phantom line position illustrated in that view. Each contact element 22 and 24 is held in place by reason of its blade type terminal leg portions being received in slots defined for them in the housing and more particularly adjacent the walls defining the downwardly open cavity 10*m* of the housing. FIG. 1 illustrates the slots at 10*h* and 10*j* for each of these contact elements 24 and 22 respectively. FIG. 2 illustrates one of these slots 10*h* and its relationship to the leg portion of the L-shaped contact element 24 received therein. FIGS. 3 and 4 illustrate the upper or fixed contact element 22 but it will be noted that the element 24 referred to previously is identical thereto and these contract components need only to be mounted so that their abutment surfaces 18, 20 contact one another as suggested in FIGS. 1 and 2 in the process of assembling a switch in accordance with the present invention. More particularly, and as best shown in FIGS. 3 and 4 each contact element 22 or 24 comprises a generally L-shaped configuration such that an initially flat sheet of metal can be bent into the configuration shown in order to form a relatively thick blade or terminal leg portion 22*b* and to provide a relatively resilient cantilevered leg portion 22*c* upon which is mounted the precious metal abutment contact 18. The location for the opening 22*a* is such that when this contact element of FIGS. 3 and 4 is provided in position to define a so-called fixed contact element for the switch the plunger 14 will pass through the opening 22*a* as described previously. On the other hand, when the contact element 22 is to be provided in the configuration illustrated for it in the lower or movable contact element position of FIGS. 1 and 2 the opening 22*a* will not be required for functional operation of this switch, but applicant has achieved a switch construction such that the same contact element 22 or 24 can be used for either the fixed or the movable contact in a switch embodying the features of the present invention.

Finally, the downwardly open cavity 10*m* for these switch contact elements is closed by a cover or base 26 having upstanding lugs 26*a* that are received in openings provided for them in the lower edges of the end walls 10*a* and 10*b* of the housing 10. One of these posts and preferably two of them 26*b* and 26*c* are so oriented and located that they engage the underside of the movable contact element 24 as best shown in FIG. 2 in order that this contact element be supported properly in its slot 10*h* and not tend to move downwardly in the slot in response to downward movement of the plunger 14 during use or operation of the switch. Post 26*b* as shown in FIG. 2 is itself adequate to prevent such inadvertent motion of the blade terminal portion of the movable contact element 24.

I claim:

1. A switch comprising a generally rectangular one-piece housing having upwardly and downwardly open cavities separated by an internal wall defined integrally in said housing, a plunger slidably received in an opening defined by said internal wall, said plunger having an upper end in said upwardly open cavity and a lower end in said downwardly open cavity, a rocker means pivotably mounting said rocker in said upwardly open cavity said rocker having a downwardly facing abutment surface engaging said plunger upper end, fixed and movable switch contact elements in said downwardly open cavity, said fixed contact element provided above said movable contact element and having an opening for loosely receiving said plunger, and said movable contact element having a cantilevered end portion that is resiliently deformable and that said plunger lower end to bias said plunger upwardly, said switch contact elements being closed when said plunger is in a raised position, and said rocker being movable from a normal up position where it is held in place by said raised plunger position to a down position wherein said plunger is moved downwardly to open said contact elements, said fixed and movable contact elements being identical to one another, each having an L-shape with said cantilevered end portion forming one leg of the L-shape and said other leg defining a terminal adjacent its end portion said terminal extending outwardly of said housing, each of said contact elements including an opening for loosely receiving said plunger as aforesaid.

2. The switch of claim 1 wherein said switch consists of only said housing, said fixed and movable switch contact elements, said rocker, said plunger, and a cover for closing said downwardly open cavity.

3. A switch comprising a generally rectangular one-piece housing having upwardly and downwardly open cavities separated by an internal wall defined integrally in said housing, a plunger slidably received in an opening defined by said internal wall, said plunger having an upper end in said upwardly open cavity and a lower end in said downwardly open cavity, a rocker means pivotably mounting said rocker in said upwardly open cavity said rocker having a downwardly facing abutment surface engaging said plunger upper end, fixed and movable switch contact elements in said downwardly open cavity, said fixed contact element provided above said movable contact element and having an opening for loosely receiving said plunger, and said movable contact element having a cantilevered end portion that is resiliently deformable and that said plunger lower end to bias said plunger upwardly, said switch contact elements being closed when said plunger is in a raised position, and said rocker being movable from a normal up positon where it is held in place by said raised plunger position to a down position wherein said plunger is moved downwardly to open said contact elements, said fixed and movable contact elements being identical to one another, each having an L-shape with said cantilevered end portion forming one leg of the L-shape and said other leg defining a terminal adjacent its end portion said terminal extending outwardly of said housing, each of said contact elements including an opening for loosely receiving said plunger as aforesaid, wherein said rocker is pivotably mounted in said upwardly open housing cavity on a pivot axis defined in part adjacent one end of said rocker and in part by said housing, said pivot axis provided between said plunger and one end wall of said housing so that said rocker has another end opposite its one pivoted end that moves through a displacement considerably greater than the displacement of said plunger, said housing having another end wall opposite said one end wall and defining at least one vertically extending slot, said rocker opposite end having at least one projecting tab slidably received in at least a portion of said slot and engaging an upper end of said slot to limit upward pivotal movement of said rocker, said rocker including a second projecting tab for engaging said opposite housing end wall to limit downward pivotal movement of said rocker.

4. The switch of claim 3 wherein said housing has another end wall opposite said one end wall and defining at least one vertically extending slot, said rocker opposite end having at least one projecting tab slidably received in at least a portion of said slot and engaging an upper end of said slot to limit upward pivotal movement of said rocker, said rocker having a second projecting tab for engaging said opposite housing end wall to limit downward pivotal movement of said rocker.

5. The switch of claim 4 wherein said switch consists of only said housing, said fixed and movable switch contact elements, said rocker, said plunger, and a cover for closing said downwardly open cavity.

6. The switch of claim 3 wherein said fixed contact element is identical to said movable contact element, each said contact element having an L-shape configuration said cantilevered end portion forming one leg of said L-shape configuration, and said other leg of said L-shape configuration having an end portion defining a terminal extending outwardly of said housing.

7. The switch of claim 6 wherein said switch consists of only said housing, said fixed and movable switch contact elements, said rocker, said plunger, and a cover for closing said downwardly open cavity.

8. The switch of claim 7 wherein said slot has a lower end adjacent said internal housing wall, said plunger opening in said internal housing wall defined by an upstanding boss.

9. The switch of claim 8 wherein said internal housing wall defines a stop surface to support said fixed contact cantilevered portion so that said movable contact cantilevered portion does not cause corresponding movement of said fixed contact element upon contact closing.

* * * * *